US008130158B2

(12) United States Patent
Kurashima et al.

(10) Patent No.: US 8,130,158 B2
(45) Date of Patent: Mar. 6, 2012

(54) ANTENNA APPARATUS AND COMMUNICATION SYSTEM INCLUDING THE SAME

(75) Inventors: Shigemi Kurashima, Shinagawa (JP); Masahiro Yanagi, Shinagawa (JP); Takashi Arita, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 355 days.

(21) Appl. No.: 12/421,770

(22) Filed: Apr. 10, 2009

(65) Prior Publication Data

US 2010/0053011 A1 Mar. 4, 2010

(30) Foreign Application Priority Data

Aug. 27, 2008 (JP) ..... 2008-217586
Oct. 1, 2008 (JP) ..... 2008-256429

(51) Int. Cl.
*H01Q 11/12* (2006.01)

(52) U.S. Cl. ..... 343/741; 343/744; 343/866

(58) Field of Classification Search ..... 343/741, 343/744, 866
See application file for complete search history.

(56) References Cited

U.S. PATENT DOCUMENTS 4,083,006 A * 4/1978 Yokoshima ..... 455/115.1
6,243,045 B1 * 6/2001 Ishibashi ..... 343/741
6,590,542 B1 * 7/2003 Briggs ..... 343/742

FOREIGN PATENT DOCUMENTS

JP 2006-19979 A 1/2006

* cited by examiner

*Primary Examiner* — Hoang V Nguyen
(74) *Attorney, Agent, or Firm* — IPUSA, PLLC

(57) ABSTRACT

An antenna apparatus is disclosed that includes a feeding portion; a looped antenna element connected to the feeding portion; and a resistor inserted into the looped antenna element.

3 Claims, 9 Drawing Sheets

ANTENNA APPARATUS AND COMMUNICATION SYSTEM INCLUDING THE SAME

BACKGROUND OF THE INVENTION

1. Field of the Invention

The present invention relates to an antenna apparatus that provides proximal communications in wide band, and a communication system including the same.

2. Description of the Related Art

A communication sheet that includes a plurality of proximal coupling portions and a plurality of relay communication circuits arranged on the surface of the sheet wherein each relay communication circuit forms communication network with the proximal coupling portions and other relay communication circuits, has been proposed.

The communication sheet data communicates with other communication sheets via the proximal coupling portions when the communication sheet touches or comes closer to other communication sheets. The communication sheet like this has been proposed in order to form a wireless communication network such as a wireless LAN (Local Area Network).

[Patent Document 1] Japanese Patent Laid-Open Publication No. 2006-19979

Since the communication sheet described above forms a communication network with other communication sheets by using capacitive coupling and the communication circuit of the communication sheet includes an LC circuit, the communication band becomes narrower and wide band communication becomes difficult.

Moreover, it is difficult to protect data confidentiality because the communication network formed by using capacitive coupling may leak electromagnetic waves or radio waves.

SUMMARY OF THE INVENTION

It is a general object of the present invention to provide an antenna apparatus and a communication system including the same that provide wide band communication, higher data confidentiality, and easier proximal communications.

Features and advantages of the present invention will be set forth in the description which follows, and in part will become apparent from the description and the accompanying drawings, or may be learned by practice of the invention according to the teachings provided in the description. Objects as well as other features and advantages of the present invention will be realized and attained by an antenna apparatus and a communication system including the same particularly pointed out in the specification in such full, clear, concise, and exact terms as to enable a person having ordinary skill in the art to practice the invention.

To achieve these and other advantages and in accordance with the purpose of the invention, as embodied and broadly described herein, an embodiment of the present invention provides an antenna apparatus including: a feeding portion; a looped antenna element connected to the feeding portion; and a resistor inserted into the looped antenna element.

Another embodiment of the present invention provides an antenna apparatus including: a ground plane; a slot portion formed through the ground plane; a feeding portion connected to the ground plane at opposite sides of the slot portion; and a resistor spaced from the feeding portion and including opposite ends connected to the ground plane in such a manner that the resistor is disposed over the slot portion.

Yet another embodiment of the present invention provides a system comprising: a first antenna apparatus including: a first feeding portion; a looped antenna element connected to the first feeding portion, and a first resistor inserted into the looped antenna element; and a second antenna apparatus including: a ground plane; a slot portion formed through the ground plane; a second feeding portion connected to the ground plane at opposite sides of the slot portion, and a second resistor spaced from the second feeding portion and including opposite ends connected to the ground plane in such a manner that the second resistor is disposed over the slot portion.

Other objects and further features of the present invention will be apparent from the following detailed description when read in conjunction with the accompanying drawings.

DESCRIPTION OF THE PREFERRED EMBODIMENTS

In the following, embodiments of the present invention will be described with reference to the accompanying drawings.

[Embodiment 1]

Figure 1:
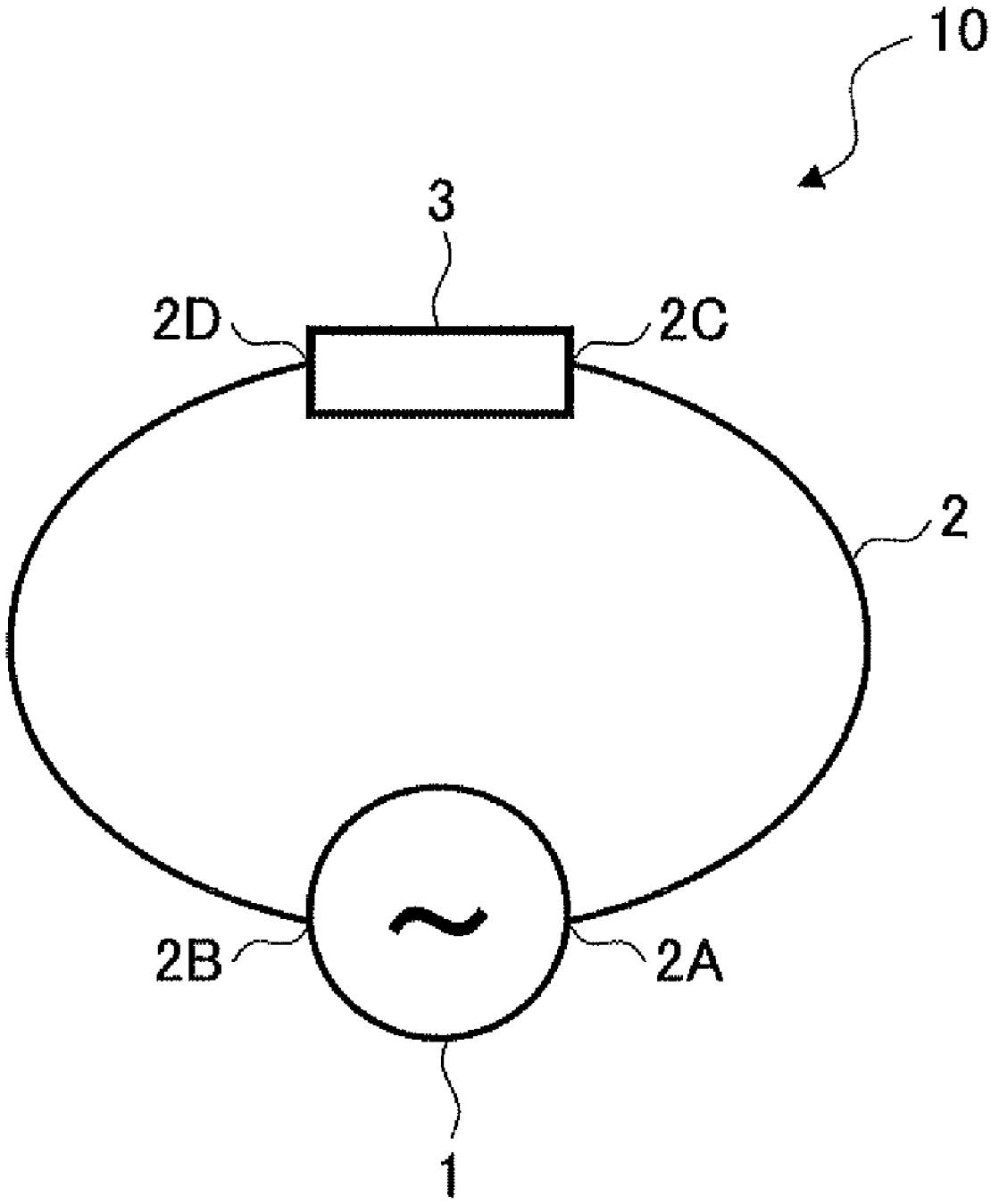
FIG. 1 is a schematic drawing of an antenna apparatus according to embodiment 1.

FIG. 1 is a schematic drawing of an antenna apparatus according to embodiment 1.

As shown in FIG. 1, an antenna apparatus 10 of embodiment 1 includes a feeding portion 1, an antenna element 2 formed into a loop shape and connected to the feeding portion 1, and a resistor 3 inserted into the antenna element 2. The resistor 3 becomes a portion of a loop formed by connection with the antenna element 2.

One end 2A and the other end 2B of the antenna element 2 are connected to the feeding portion 1. The resistor 3 is inserted at the midpoint between the one end 2A and the other end 2B of the antenna element 2.

The feeding portion 1 is a terminal via which electrical power is fed to the antenna element 2 from an external power supply. A terminal of a coaxial cable, for example, is connected to the feeding portion 1.

A cable core of the coaxial cable is connected to the one end 2A of the antenna element 2, and a shielded line of the coaxial cable is connected to the other end 2B of the antenna element 2, for example.

A high-frequency voltage, for example at around 3 GHz to 5 GHz, is applied to the feeding portion 1 via the coaxial cable.

The high-frequency voltage is fed to the antenna element 2 via the feeding portion 1. The antenna element 2 is made of, for example, copper. The antenna element 2 may be an antenna element made of copper and patterned into a loop shape on a surface of a printed circuit board, for example.

Further, the antenna apparatus 10 includes the resistor 3 which is disposed at the midpoint between the one end 2A and the other end 2B of the antenna element 2. More specifically, the resistor 3 is connected between connecting points 2C and 2D of the antenna element 2 in order to form the loop.

Although the antenna element 2 shown in FIG. 1 is formed into a loop shape, the antenna element 2 may be formed into a rhombic shape, i.e. a rhombic antenna. A rhombic antenna has an advantageous effect in a case that directional characteristics are necessary or desired.

The length of the antenna element 2 connected to the feeding portion 1 may be, for example, made approximately equal to a single-wavelength of the communication frequency at which the antenna apparatus operates. In the case that the communication frequency is 3 GHz, the length of the antenna element 2, i.e. the length between the one end 2A and the other end 2B and the length of the resistor 3 inserted thereinto, becomes 100 mm.

The resistor 3 is inserted into the antenna element 2 between the one end 2A and the other end 2B. The resistance of the resistor 3 may be set to, for example, 1 kΩ. Although the resistance of the resistor 3 is set to 1 kΩ, the resistance is not limited to 1 kΩ. The resistance can be varied as long as the proximal communication of which the communication distance is less than a few centimeters can be provided.

As the antenna element of embodiment 1 is designed to provide less than a few centimeter proximal communication by using the antenna element 2 with the resistor 3 inserted thereinto, almost all of the electrical power fed via the feeding portion 1 is consumed at the resistor 3.

The antenna apparatus 10 of embodiment 1 includes the antenna element 2 and the resistor 3. In addition, the antenna apparatus 10 of embodiment 1 does not include inductance (L) or capacitance (C).

The antenna apparatus 10 provides an ultra-wide frequency band when a high-frequency voltage is fed to the antenna element 2 via the feeding portion 1. In addition, because the as-shown antenna apparatus 10 does not include inductance (L) or capacitance (C), the antenna apparatus 10 does not cause resonance.

Figure 2:
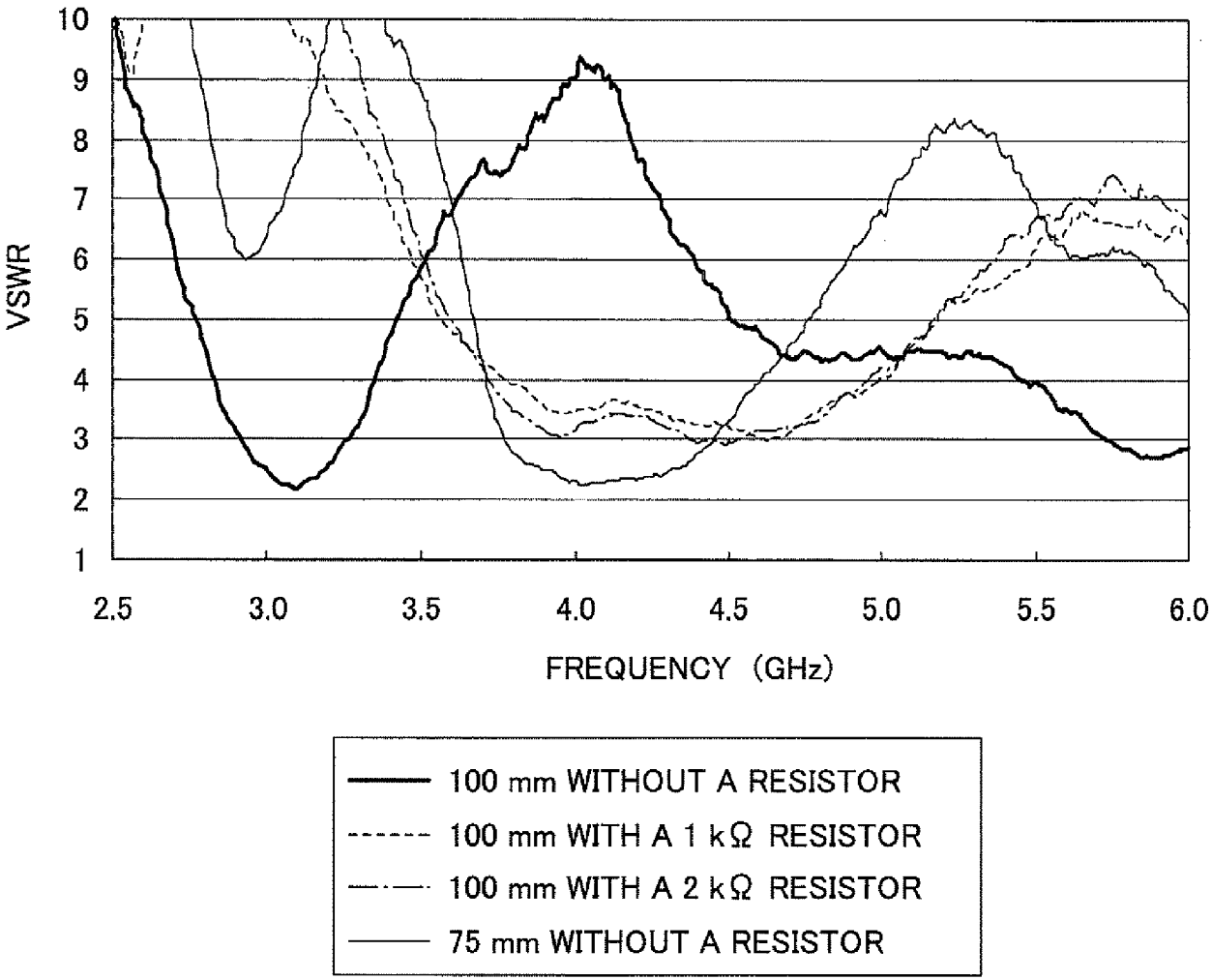
FIG. 2 is a graph showing VSWR (Voltage Standing Wave Ratio) characteristics of the antenna apparatus of embodiment 1.

FIG. 2 is a graph showing VSWR (Voltage Standing Wave Ratio) characteristics of an antenna apparatus of embodiment 1.

The VSWR characteristic represented in dashed line shown in FIG. 2 is obtained in the condition where the length of the antenna element 2 and the resistor 3 is 100 mm, and the resistance of the resistor 3 is 1 kΩ. As to the other characteristics shown in FIG. 2, the alternating long and short dash line characteristic is obtained by an antenna element and a resistor of which the length is 100 mm and the resistance is 2 kΩ, the heavy solid line characteristic is obtained by an antenna element and a resistor of which the length is 100 mm and the resistance is 0 kΩ (i.e. without a resistor), and the solid line characteristic is obtained with an antenna element and a resistor of which the length is 75 mm and the resistance is 0 kΩ (i.e. without a resistor). These three characteristics are shown for comparison.

As shown in the dashed line VSWR characteristic, the antenna apparatus 10 provides a frequency band, with VSWR less than 4.0, ranged from 3.7 GHz to 5.0 GHz, i.e. the band width is 1.3 GHz. The same characteristic is obtained with the antenna apparatus that has a 2 kΩ resistor.

In contrast, as shown in the heavy solid line VSWR characteristic, the antenna apparatus (100 mm, 0 kΩ) provides a frequency band, with VSWR less than 4.0, ranged from 2.8 GHz to 3.4 GHz, i.e. the band width is narrowed to 0.6 GHz. This frequency band is shifted out of the frequency band ranged from 3 GHz to 5 GHz that is available to UWB communication.

Further, as shown in the solid line VSWR characteristic, the antenna apparatus (75 mm, 0 kΩ) provides a frequency band, with VSWR less than 4.0, ranged from 3.7 GHz to 4.6 GHz, i.e. the band width is narrowed to 0.9 GHz.

As will be appreciated from the above, the antenna apparatus of embodiment 1 provides an ultra wide frequency band that is suitable for UWB communication, and the band width is 1.4 times wider than that of the antenna apparatus (75 mm, 0 kΩ).

According to embodiment 1 of the present invention, it is possible to provide an antenna apparatus that has a frequency band suitable for UWB communication by inserting a resistor into a looped antenna element.

Moreover, since the electrical power is consumed at the resistor 3, the antenna apparatus of embodiment 1 is suitable for a low electrical power communication use. And the communication distance may be set to less than a few centimeters. This communication distance makes it possible to not be influenced by a disturbance.

Further, since the antenna apparatus includes the resistor, the antenna apparatus can provide wide band communication. In addition, the as-shown antenna apparatus of embodiment 1 does not cause resonance, because the as-shown antenna apparatus does not include inductance (L) or capacitance (C).

As described above, according to embodiment 1, a traveling-wave-type antenna apparatus that is suitable for low electrical power communication and wide band communication is provided merely by inserting the resistor into the looped antenna element 2.

As shown in the VSWR characteristics, since the antenna apparatus has a wide band, large volume UWB data communication becomes available.

It is noted that the antenna element 2 and resistor 3 may be formed on the printed circuit board by patterning a metal film formed over the printed circuit board.

Although the resistor 3 of the above-described embodiment is inserted into the midpoint between the one end 2A and the other end 2B of the antenna element 2, the insertion position of resistor 3 between the ends 2A and 2B is not limited thereto. The resistor 3 may be inserted into any position between the ends 2A and 2B as long as the low electrical power UWB communication is provided.

[Embodiment 2]

Figure 3:
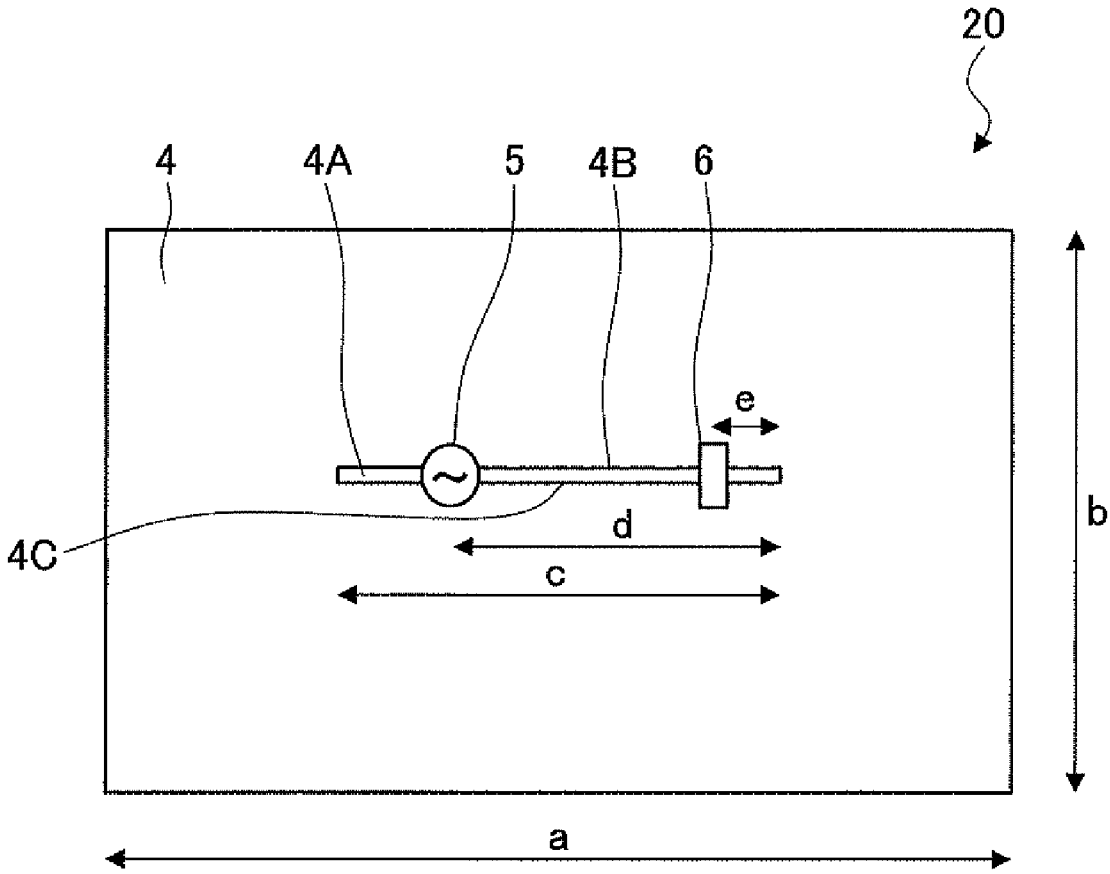
FIG. 3 is a schematic drawing of an antenna apparatus included in a communication device according to embodiment 2.

FIG. 3 is a schematic drawing of a circuit diagram of an antenna apparatus according to embodiment 2.

An antenna apparatus 20 of embodiment 2 includes a ground plane 4, a feeding portion 5 connected to a slot portion 4A of the ground plane 4, and a resistor 6 connected to the slot portion 4A.

The illustrated ground plane 4 is an element that has a substantially rectangular shape in planar view, and is grounded. The ground plane 4 is a metallic film, for example, made of copper, for example. The ground plane 4 has the slot portion 4A that is formed longitudinally and substantially in the center in planar view. The slot portion 4A is cutout through the ground plane 4.

The feeding portion 5 is a terminal via which electrical power is fed to the antenna apparatus 20 from an external power supply. According to embodiment 2, the feeding portion 5 is connected to the ground plane 4 over the slot portion 4A in a manner that a cable core of a coaxial cable is connected to one side 4B of the slot portion 4A and a shielded line of the coaxial cable is connected to the other side 4C. A high-frequency voltage, for example at around 3 GHz to 5 GHz, is applied to the feeding portion 5 via the coaxial cable.

The resistor 6 is connected to the ground plane 4 over the slot portion 4A in a manner that one end of the resistor 6 is connected to the side 4B of the slot portion 4A and the other end of the resistor 6 is connected to the other side 4C of the slot portion 4A. Thus the resistor 6 is disposed over the slot while the ends of the resistor 6 are connected to the ground plane 4. The resistance of the resistor 6 is set to, for example, 51Ω.

The resistance of the resistor 6 is not limited to 51Ω. The resistance can be varied as long as impedance matching between the feeding portion 5 and the resistor 6 is obtained.

The antenna apparatus of embodiment 2 includes the resistor 6. The antenna apparatus provides an ultra-wide frequency band when a high-frequency voltage is fed to the ground plane 4 via the feeding portion 5. In addition, the as-shown antenna apparatus 20 does not cause resonance, because the as-shown antenna apparatus of embodiment 2 does not include inductance (L) or capacitance (C).

Figure 4:
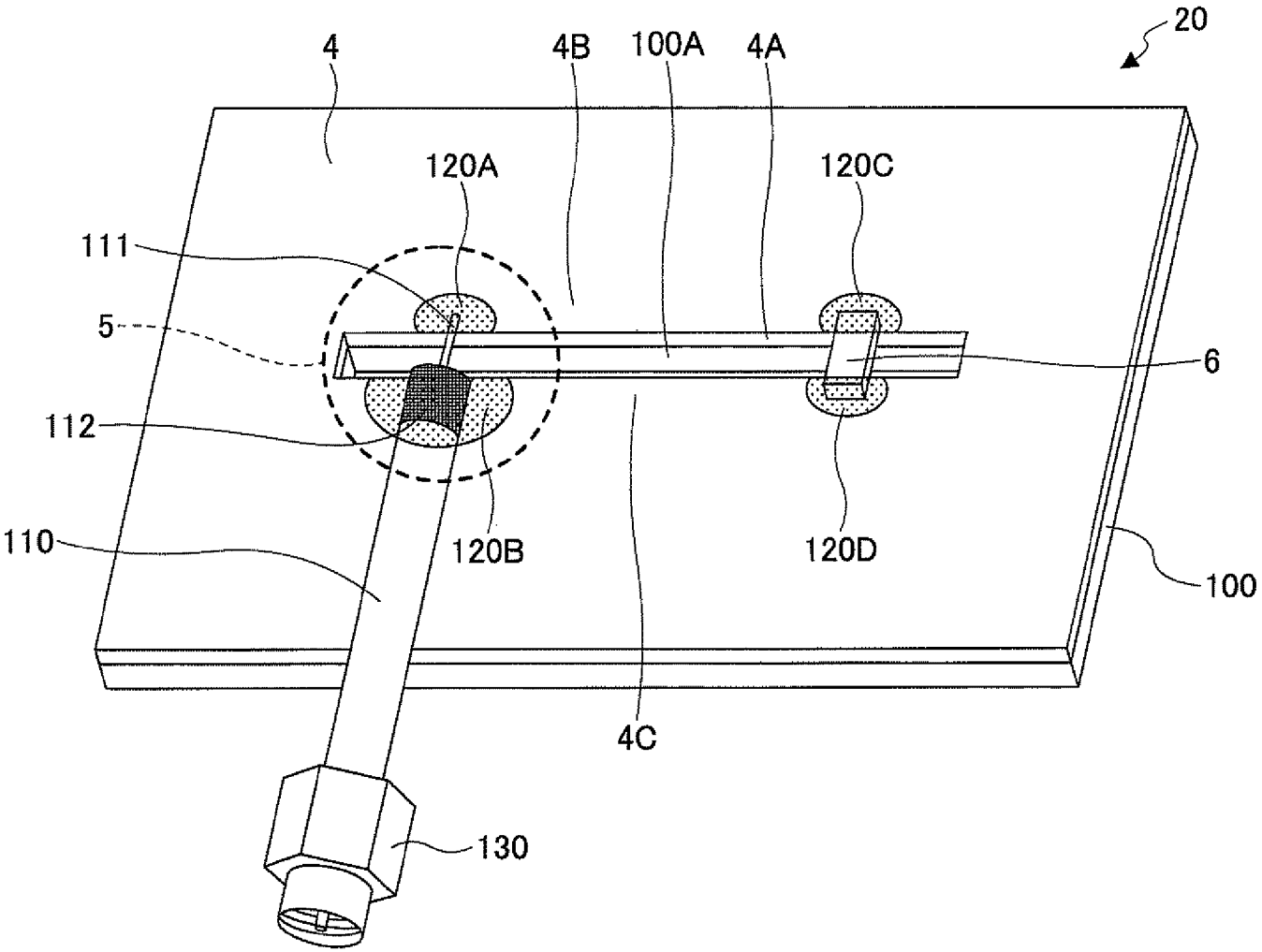
FIG. 4 is a schematic drawing of a detailed configuration of an antenna apparatus according to a configuration example 1 of embodiment 2 shown in perspective view.

FIG. 4 is a schematic drawing of a detailed configuration of an antenna apparatus according to a configuration example 1 of embodiment 2 shown in perspective view.

The ground plane 4 is formed on a surface of the printed circuit board 100. The printed circuit board 100 may be comprised of, for example, FR4 (glass epoxy board).

The printed circuit board 100 has a slot portion 100A. The dimensions of the opening of the slot portion 100A, i.e. the length and width of the opening of the slot 100A, may be the same as those of the slot portion 4A formed in the ground plane 4.

The feeding portion 5 is disposed to the left of the center position of the slot portion 4A in the longitudinal direction. A coaxial cable 110 is connected to the feeding portion 5. A core cable 111 is connected to one side 4B of the slot portion 4A by a solder 120A, and a shielded line 112 is connected to the other side 4C by a solder 120B.

The illustrated coaxial cable 110 has an SMA (Sub-Miniature A) connector 130 in the end.

The resistor 6 is disposed to the right of the center position of the slot portion 4A in the longitudinal direction. One end of the resistor 6 is connected to the side 4B by a solder 120C, and the other end of the resistor 6 is connected to the other side 4C by a solder 120D. Herein, the resistance of the resistor may be set to be, for example, 51Ω.

According to the antenna apparatus 20 of the configuration example 1 of embodiment 2, electrical power is fed to the feeding portion 5 from an external power supply via coaxial cable 110.

The antenna apparatus of the configuration example 1 of embodiment 2 includes the resistor 6. In addition, the antenna apparatus of the configuration example 1 of embodiment 2 does not include inductance (L) or capacitance (C).

The antenna apparatus 20 of the configuration example 1 of embodiment 2 provides an ultra-wide frequency band when a high-frequency voltage is fed to the ground plane 4 via the feeding portion 5. In addition, the as-shown antenna apparatus 20 does not cause resonance, because the as-shown antenna apparatus of the configuration example 1 of embodiment 2 does not include inductance (L) or capacitance (C).

Figure 5A:
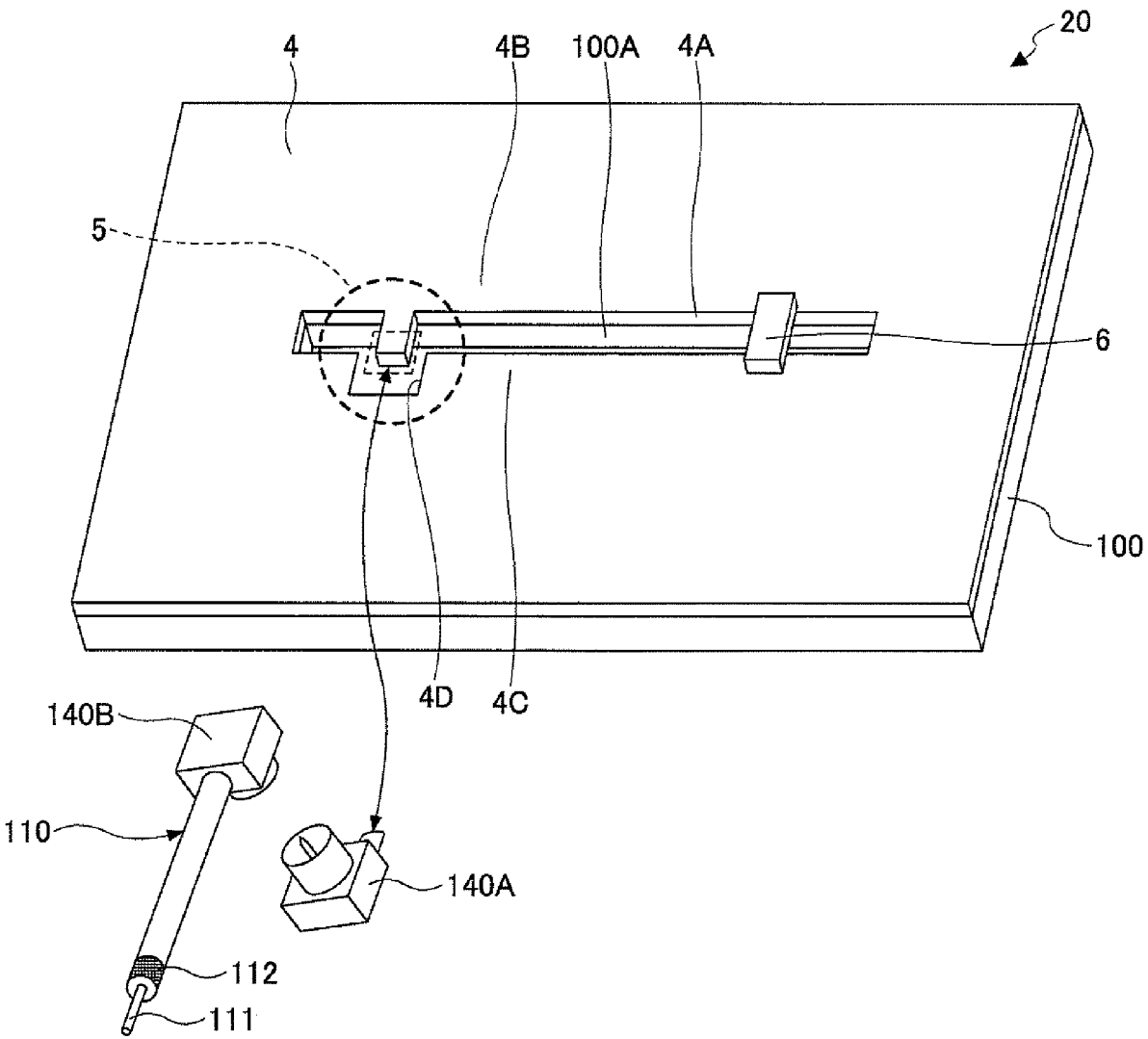
FIG. 5A is a schematic drawing of a detailed configuration of an antenna apparatus according to a configuration example 2 of embodiment 2 shown in perspective view.
Figure 5B:
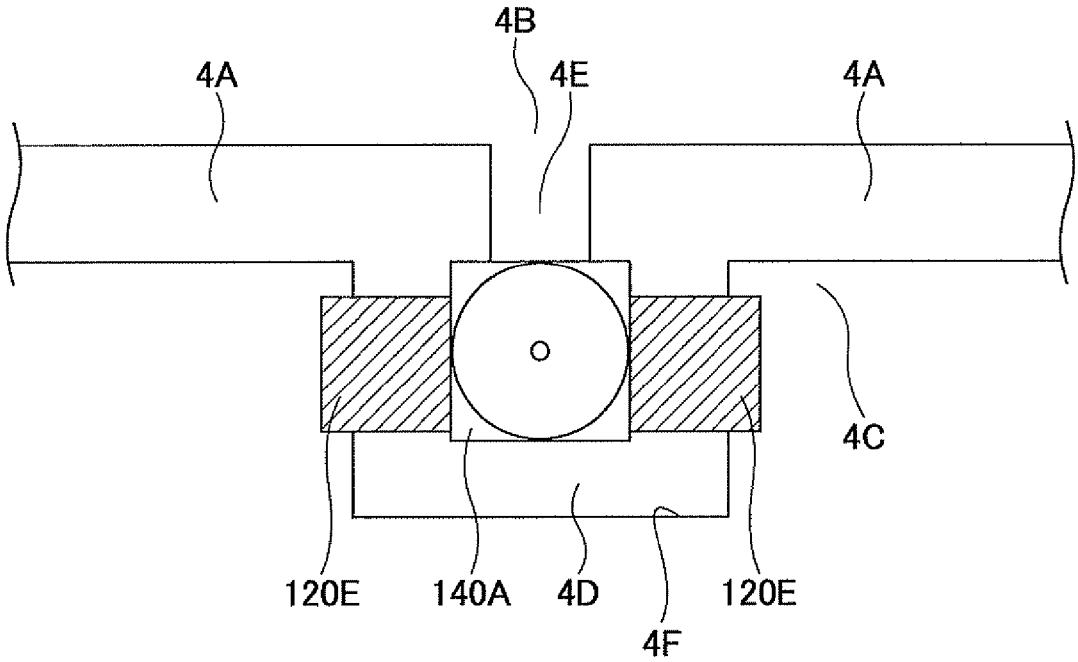
FIG. 5B is an enlarged schematic drawing of a feeding portion 5 in planar view.

FIG. 5A is a schematic drawing of a detailed configuration of an antenna apparatus according to a configuration example 2 of embodiment 2 shown in perspective view. FIG. 5B is an enlarged schematic drawing of a feeding portion 5 in planar view.

The differences between the antenna apparatus of the configuration example 2 of embodiment 2 and the antenna apparatus of the configuration example 1 of embodiment 2 are configurations of a slot portion 4A and a feeding portion 5.

According to the configuration example 2 of embodiment 2, the slot portion 4A has a U-shaped portion 4D. The U-shaped portion 4D forms a projecting portion 4E on the side 4B, and a recessed portion 4F in the other side 4C. The projecting portion 4E and the recessed portion 4F are facing each other in planar view, and thus form the U-shaped portion 4D as shown in FIG. 5B.

An SMT connector 140A is connected to the projecting portion 4E and the wall of the recessed portion 4F. The projecting portion 4E is connected to a core terminal of the SMT connector 140A, and the wall of the recessed portion 4F is connected to a ground terminal of the SMT 140A. Thus, the side 4B of the ground plane 4 is connected to the core terminal, and the other side 4C is connected to the ground terminal.

The coaxial cable 110 has an SMT connector 140B at its end (FIG. 5A). Thus, according to the antenna apparatus 20 of the configuration example 2 of embodiment 2, electrical power is fed to the feeding portion 5 from an external power supply via coaxial cable 110 and the SMT connectors 140A and 140B.

The antenna apparatus of the configuration example 2 of embodiment 2 includes the resistor 6. In addition, the as-shown antenna apparatus of the configuration example 2 of embodiment 2 does not include inductance (L) or capacitance (C).

The antenna apparatus 20 of the configuration example 2 of embodiment 2 provides an ultra-wide frequency band when a high-frequency voltage is fed to the ground plane 4 via the feeding portion 5. In addition, the as-shown antenna apparatus 20 of the configuration example 2 of embodiment 2 does not cause resonance, because the as-shown antenna apparatus 20 of the configuration example 2 of embodiment 2 does not include inductance (L) or capacitance (C).

Figure 6:
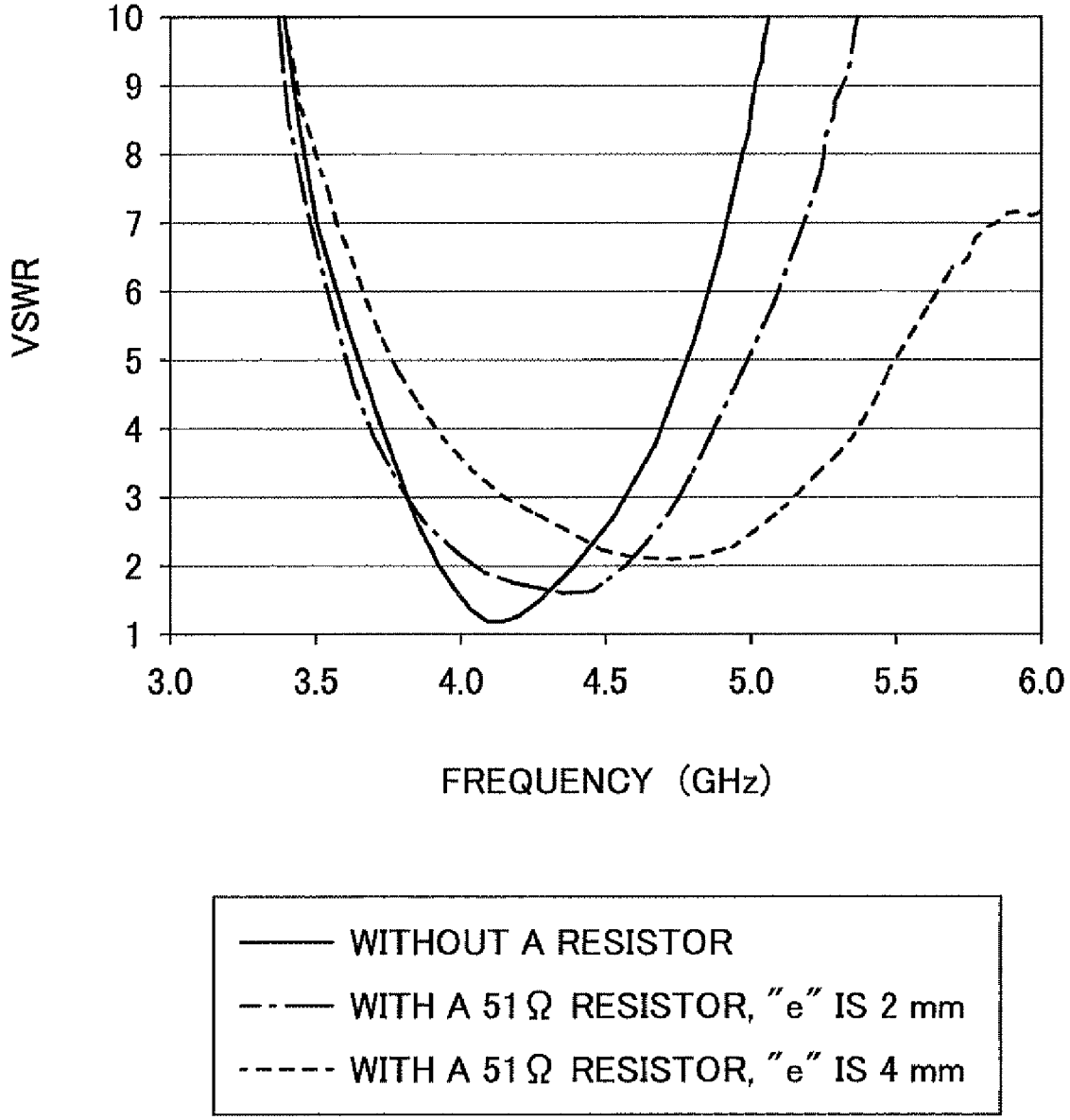
FIG. 6 is a graph showing VSWR characteristics of an antenna apparatus included in a communication device according to embodiment 2.

FIG. 6 is a graph showing VSWR characteristics of an antenna apparatus included in a communication device according to embodiment 2. The VSWR characteristics shown in FIG. 6 are obtained in the condition where the length of a longitudinal side of the ground plane 4 "a" is 39 mm, the width of the ground plane 4 "b" is 29 mm, the length of the slot portion 4A "c" is 24 mm, the length from the right side end of the slot portion 4A to the feeding portion 5 "d" is 21.1 mm, and the length from the right side end of the slot portion 4A to the resistor 6 "e" is varied.

The VSWR characteristic represented in dashed line shown in FIG. 6 is obtained in the condition where the length "e" is 4 mm and the resistance of the resistor 6 is 51Ω. As to the other characteristics, the alternating long and short dash line characteristic is obtained in the condition where the length "e" is 2 mm and the resistance of the resistor 6 is 51Ω, and the solid line characteristic is obtained in the condition where the length "e" is 4 mm and the resistance of the resistor 6 is 0Ω (i.e. without a resistor).

In the condition where "e" is 4 mm, shown in the dashed line, the antenna apparatus 20 provides a frequency band, with VSWR less than 4.0, ranged from 3.92 GHz to 5.36 GHz, i.e. the band width is 1.44 GHz.

Further, in the condition where "e" is 2 mm, shown in the alternating long and short dash line, the antenna apparatus provide the frequency band, with VSWR less than 4.0, ranged from 3.69 GHz to 4.87 GHz, i.e. the band width is 1.18 GHz.

In contrast, in the condition where "e" is 4 mm and resistance is 0Ω, shown in the solid line, the antenna apparatus provide the frequency band, with VSWR less than 4.0, ranged from 3.73 GHz to 4.69 GHz, i.e. the band width is 0.96 GHz.

As will be appreciated from the above, the antenna apparatus 20 of embodiment 2 provides an ultra wide frequency band that is suitable for UWB communication, and the band width is 15 times wider than that of the antenna apparatus (4 mm, 0Ω).

According to embodiment 2 of the present invention, it is possible to provide the antenna apparatus that has the frequency band suitable for UWB communication by connecting a resistor over a slot that is formed in the ground plane.

Since the electrical power is consumed at the resistor 6, the antenna apparatus of embodiment 2 is suitable for low electrical power communication use. And the communication distance may be set to be less than a few centimeters. This communication distance makes it possible to not be influenced by a disturbance.

Further, since the slot portion 4A provides directional characteristics, it is possible to improve data confidentiality by optimizing the geometries and dimensions of the slot portion 4A.

Further, since the antenna apparatus of embodiment 2 include the resistor, the antenna apparatus of embodiment 2 can provide wide band communication. In addition, the as-shown antenna apparatus of embodiment 2 does not cause resonance, because the as-shown antenna apparatus does not include inductance (L) or capacitance (C).

As will be appreciated from the above, according to embodiment 2, a traveling-wave-type antenna apparatus that is suitable for low electrical power communication, high data confidentiality, and wide band communication is provided merely by connecting the resistor 6 to the ground plane 4 over the slot portion 4A.

As shown in the VSWR characteristics, since the antenna apparatus has a wide band, large volume UWB data communication becomes available.

It is noted that the geometries and dimensions of the slot portion 4A may be varied in order to optimize the desired characteristics of the antenna apparatus 20.

[Embodiment 3]

Figure 7A:
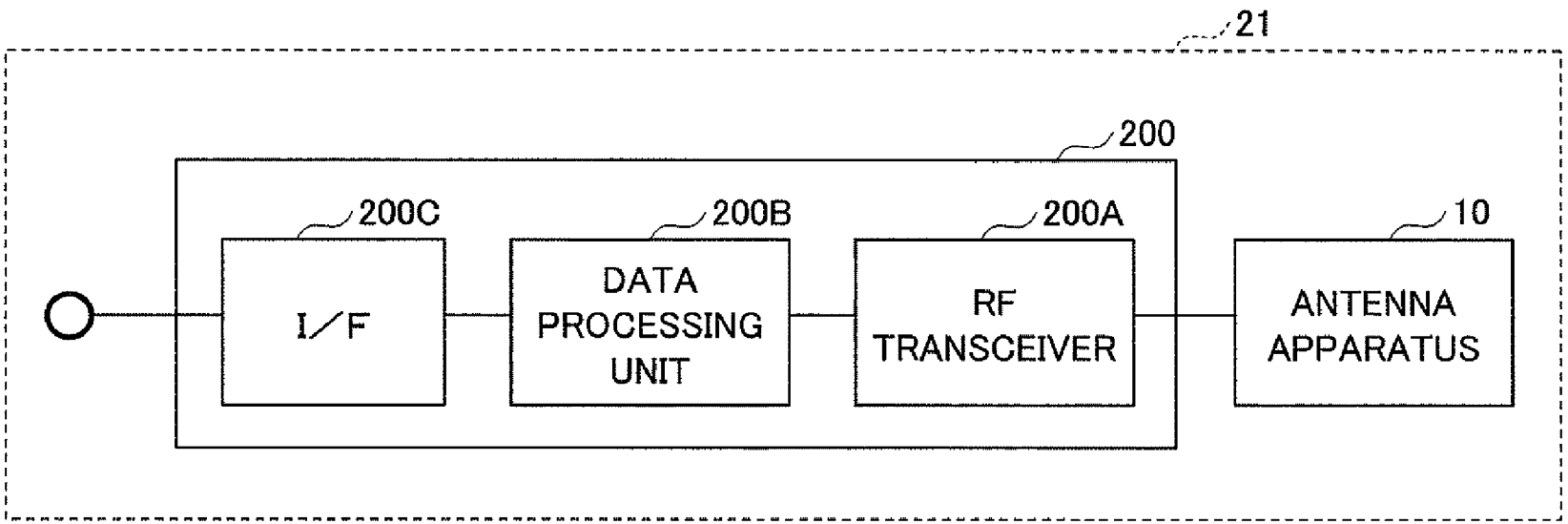
FIG. 7A is a schematic drawing of a circuit configuration included in a communication system of embodiment 3.
Figure 7B:
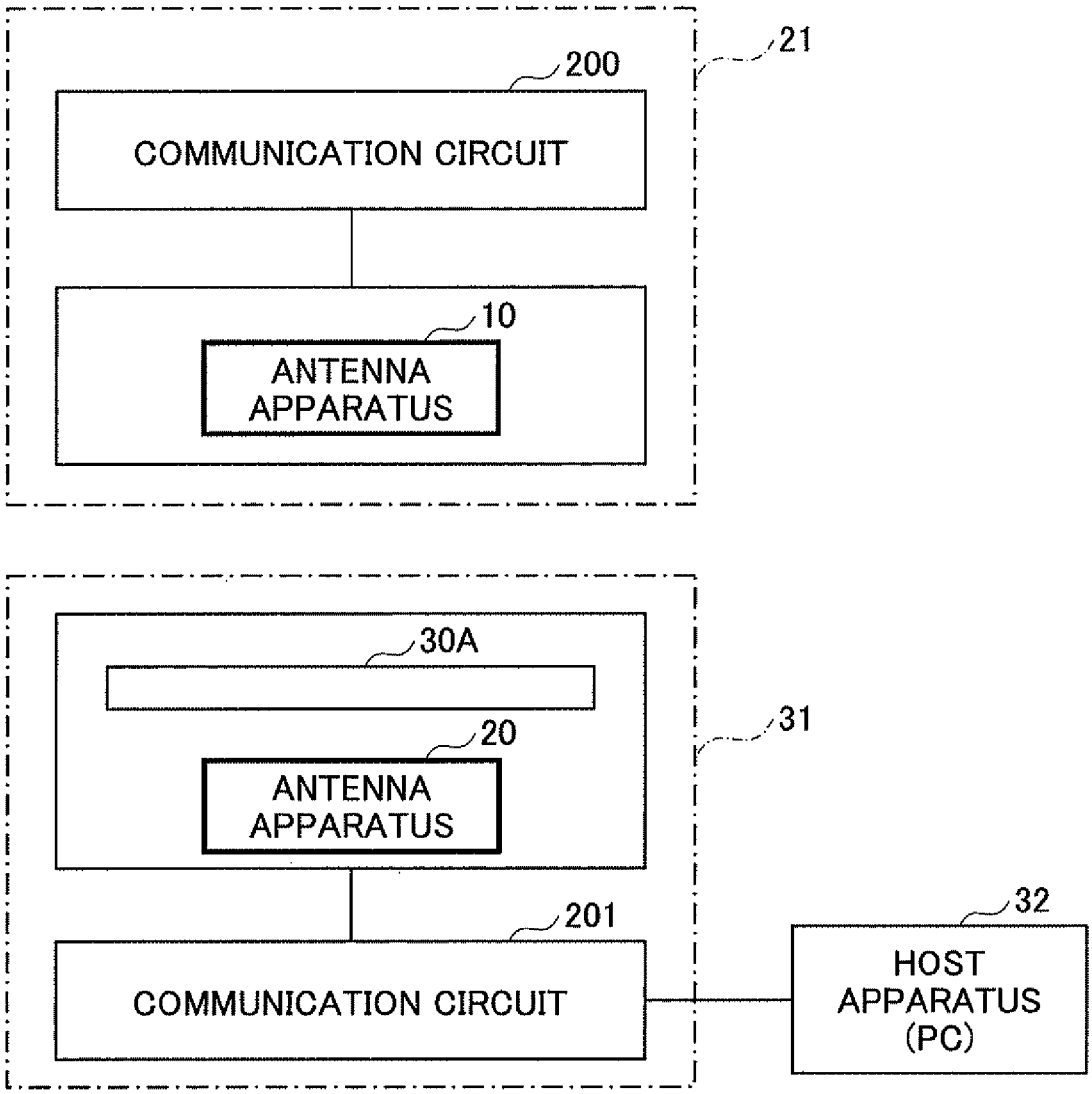
FIG. 7B is a schematic drawing of a block diagram of the communication system of embodiment 3.

FIG. 7A is a schematic drawing of a circuit configuration included in a communication system of embodiment 3. FIG. 7B is a schematic drawing of a block diagram of the communication system of embodiment 3. The communication system of embodiment 3 includes the antenna apparatus 10 of embodiment 1 and the antenna apparatus 20 of embodiment 2.

According to embodiment 3, the antenna apparatus 10 of embodiment 1 is included in a terminal device 21, and the antenna apparatus 20 of embodiment 2 is included in a host communication device 31 that is connected to a host apparatus 32 as shown in FIG. 7B. The terminal device 21 includes the antenna apparatus 10 and a communication circuit 200, and the host communication device 31 includes the antenna apparatus 20 and a communication circuit 201. Both the terminal device 21 and the host communication device 31 include a communication circuit 200, 201 respectively. The terminal device 21 and the communication device 31 communicate with each other via the antenna apparatuses 10 and 20.

FIG. 7A shows an exemplary configuration on the communication circuit 200 of the terminal device 21. The communication circuit 201 of the host communication device 31 may comprise the same configuration and thus will not be described.

The communication circuit 200 includes an RF transceiver 200A, a data processing unit 200B, and an interface circuit (I/F) 200C. As shown in FIG. 7A, the communication circuit 200 is connected to the antenna apparatus 10 included in the terminal device 21. Similarly, the other communication circuit 201 is connected to the antenna: apparatus 20 included in the host communication device 31.

As shown in FIG. 7B, the terminal device 21 includes the communication circuit 200 and the antenna apparatus 10, and the host communication device 31 includes the communication circuit 201 and the antenna apparatus 20. A host apparatus 32 is connected to the host communication device 31.

The terminal device 21 and the host communication device 31 data communicate with each other via the antenna apparatuses 10 and 20.

In the terminal device 21, the interface circuit 200C is connected to a bus line that is connected to a central processing unit of the terminal device 21. In the host communication device 31, the interface circuit 200C is connected to a bus line that is connected to the host apparatus 32.

The RF transceiver 200A superimposes transmitting data that is input from the data processing unit 200B onto an RF signal (carrier wave), modulates the superimposed data, and then outputs the modulated data. On the other hand, the RF transceiver 200A demodulates the data received via the antenna apparatuses 10 or 20, removes the RF signal, and then outputs the data to the data processing unit 200B.

The data processing unit 200B converts analog transmitting data into digital data, and converts digital received data into analog data.

The interface circuit 200C in the terminal device 21 and the host communication device 31 data communicate each other.

Herein, for example, the terminal device 21 may be any of a cellular phone handset, a digital camera, a video camera, or a music player etc.

Moreover, for example, the host apparatus 32 may be any of a PC (personal computer), or a server etc.

Herein, the terminal device 21 may be composed of a PC. In this case, it is possible to data communicate between the PC and the host apparatus 32.

When the antenna apparatus 10 of the terminal device 21 is proximate to the antenna apparatus 20 of the host communication device 31, large volume UWB data can be communicated between the terminal device 21 and the host apparatus 32. For example, a large volume data such as graphics data or music data may be transmitted quickly between the terminal device 21 and the host apparatus 32.

As to the proximate communication as described above, the data communication becomes easy, because it is not necessary to connect the terminal device 21 to the host communication device 31. It is possible to reproduce the data transmitted from the terminal device 21, in the host apparatus 32, merely by moving the terminal device 21 close to the host communication device 31.

The antenna apparatus 20 of the host communication device 31 may include a magnet 30A (FIG. 7A), in the case that a body of the terminal device 21 is made of a magnetic material. In such case, the terminal device 21 can be disposed more stably on the host communication device 31.

A member that is made of high-dielectric constant material or high magnetic permeability material may be attached to the surface of the host communication device 31. In the former case, i.e. high-dielectric constant material, the leakage of the electric field will be reduced between the terminal device 21 and the host communication device 31. In the latter case, i.e. high magnetic permeability material, the leakage of the magnetic field will be reduced between the terminal device 21 and the host communication device 31. For example, a ceramic board of which the dielectric constant is more than 1.0 may be used as the high-dielectric constant material, and a board made of ferrite of which the magnetic permeability is more than 1.0 may be used as the high-magnetic permeability material.

The shape of the antenna apparatus 20 included in the communication system of embodiment 3 is not limited to the shape of the antenna apparatus 20 that has the slot portion 4A of embodiment 2. A traveling-wave-type antenna apparatus may be used as the antenna apparatus 20.

As described above, the antenna apparatus 10 of embodiment 1 is included in the terminal device 21, and the antenna apparatus 20 of embodiment 2 is included in the host communication device 31. However, it will be appreciated that the antenna apparatus 20 may be included in the terminal device 21, and the antenna apparatus 10 may be included in the host communication device 31.

The antenna apparatus 10 may be included in each of the terminal device 21 and the host communication device 31 respectively, or the antenna apparatus 20 may be included in each of the terminal device 21 and the host communication device 31.

The present invention is not limited to these embodiments, but variations and modifications may be made without departing from the scope of the present invention.

The present application is based on Japanese Priority Applications Nos. 2008-256429 and 2008-217586 filed on Oct. 1, 2008, and Aug. 27, 2008, respectively, with the Japanese Patent Office, the entire contents of which are hereby incorporated by reference.

What is claimed is:

1. An antenna apparatus comprising:

a feeding portion;

a looped antenna element connected to the feeding portion; and a resistor inserted into the looped antenna element, wherein the antenna apparatus includes no inductor and no capacitor;

the looped antenna element includes a first part and a second part;

the feeding portion is connected to a first end of the first part and a first end of the second part; and the resistor is connected to a second end of the first part and a second end of the second part.

2. The antenna apparatus as claimed in claim 1, wherein the looped antenna element is a patterned metallic film on a surface of a printed circuit board.

3. The antenna apparatus as claimed in claim 1, wherein the length of the looped antenna element and the resistor inserted thereinto is made approximately equal to a single-wavelength of the communication frequency at which the antenna apparatus operates.

* * * * *